United States Patent [19]

Haavik

[11] Patent Number: 4,613,283

[45] Date of Patent: Sep. 23, 1986

[54] LIQUID RING COMPRESSORS

[75] Inventor: Harold K. Haavik, South Norwalk, Conn.

[73] Assignee: The Nash Engineering Company, Norwalk, Conn.

[21] Appl. No.: 748,821

[22] Filed: Jun. 26, 1985

[51] Int. Cl.[4] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,797,980 | 3/1931 | Jennings | 417/68 |
| 1,847,548 | 3/1932 | Adams | 417/68 |
| 1,847,586 | 3/1932 | Adams | 417/68 |
| 2,223,670 | 12/1940 | Adams | 417/68 |
| 2,672,276 | 3/1954 | Adams | 417/68 |
| 3,043,498 | 7/1962 | Gabbioneta | 417/68 |
| 3,221,659 | 12/1965 | Adams | 417/69 |
| 3,894,812 | 7/1975 | Huse | 417/68 |
| 4,521,161 | 6/1985 | Olsen et al. | 417/68 |

FOREIGN PATENT DOCUMENTS

| | | | |
|---|---|---|---|
| 617661 | 4/1961 | Canada | 417/68 |

*Primary Examiner*—William L. Freeh
*Assistant Examiner*—Paul F. Neils
*Attorney, Agent, or Firm*—Robert R. Jackson; David W. Plant

[57] ABSTRACT

A double-lobe liquid ring gas compressor includes a port member having two circumferentially spaced intake ports and two circumferentially spaced discharge ports. The intake ports are axially offset from the discharge ports. The intake ports are connected to a common intake passage in the port member, and the discharge ports are similarly connected to a common discharge passage in the port member. These passages respectively communicate with intake and discharge manifolds in a head member which can be identical to the head member of a single-lobe liquid ring vacuum pump.

9 Claims, 12 Drawing Figures

LIQUID RING COMPRESSORS

BACKGROUND OF THE INVENTION

This invention relates to gas pumps of the type known as liquid ring pumps, and more particularly to liquid ring pumps for compressing gases to pressures above atmospheric pressure.

The typical liquid ring vacuum pump has one intake and one compression stroke per cycle. This is a so-called single-lobe pump. The asymmetrical construction of a single-lobe pump is acceptable in a liquid ring vacuum pump which is generally limited to a pressure differential across the pump of 15 to 20 p.s.i.g. Liquid ring compressors (i.e., liquid ring pumps used to compress gases to superatmospheric pressure) are, however, capable of achieving pressure differentials substantially greater than 15 to 20 p.s.i.g. Above about 25 p.s.i.g. the asymmetrical design of single-lobe pumps becomes a significant problem due to the practical limits imposed by rotor shaft stress and deflection caused by unbalanced forces in the pump. Accordingly, liquid ring compressors for providing pressure differentials above about 25 p.s.i.g. typically have a balanced double-lobe design (i.e., two intake and two compression strokes per cycle) which significantly reduces force imbalances acting on the shaft.

Heretofore the substantially different designs of liquid ring vacuum pumps and high pressure liquid ring compressors have generally precluded the design of common parts useful in both vacuum pumps and compressors. This effectively increases the cost of both the vacuum pumps and the compressors. In addition, the double-lobe design of high pressure liquid ring compressors has previously necessitated the use of complex, multi-passage heads to accommodate the dual intake and dual discharge passages of such compressors. This has increased the complexity and cost of high pressure liquid ring compressors.

In view of the foregoing, it is an object of this invention to provide liquid ring compressors which can have a substantial number of parts in common with liquid ring vacuum pumps.

Another object of this invention is to provide less complex and less costly double-lobe liquid ring compressors.

Still another object of this invention is to provide lower cost double-lobe liquid ring compressors which can have a substantial number of parts in common with single-lobe liquid ring vacuum pumps.

SUMMARY OF THE INVENTION

These and other objects of the invention are accomplished in accordance with the principles of the invention by providing a conically or cylindrically ported double-lobe liquid ring compressor having a port member including two diametrically opposite intake ports for admitting gas to be compressed to the rotor of the pump, and two diametrically opposite discharge ports axially displaced from the intake ports for receiving compressed gas from the rotor. The intake ports are interconnected within the port member and communicate with the intake manifold in the head member of the pump at the same location as the single intake port passage in a similar conically or cylindrically ported single-lobe liquid ring vacuum pump. The discharge ports are similarly interconnected within the port member (but separated from the intake port passage) and communicate with the discharge manifold in the head member at the same location as the single discharge passage in the above-mentioned vacuum pump. Accordingly, the head member of the double-lobe compressor can be of simple design with one intake passage and one discharge passage. The double-lobe compressor of this invention is therefore less costly and can use the same rotor, the same head member, the same bearing brackets, the same shaft, etc., as the above-mentioned single-lobe vacuum pump. Only the port member and the housing need be changed to convert the single-lobe vacuum pump to the double-lobe compressor of this invention.

Further features of the invention, its nature and various advantages will be more apparent from the accompanying drawings and the following detailed description of the invention.

DETAILED DESCRIPTION OF THE INVENTION

Figure 1:
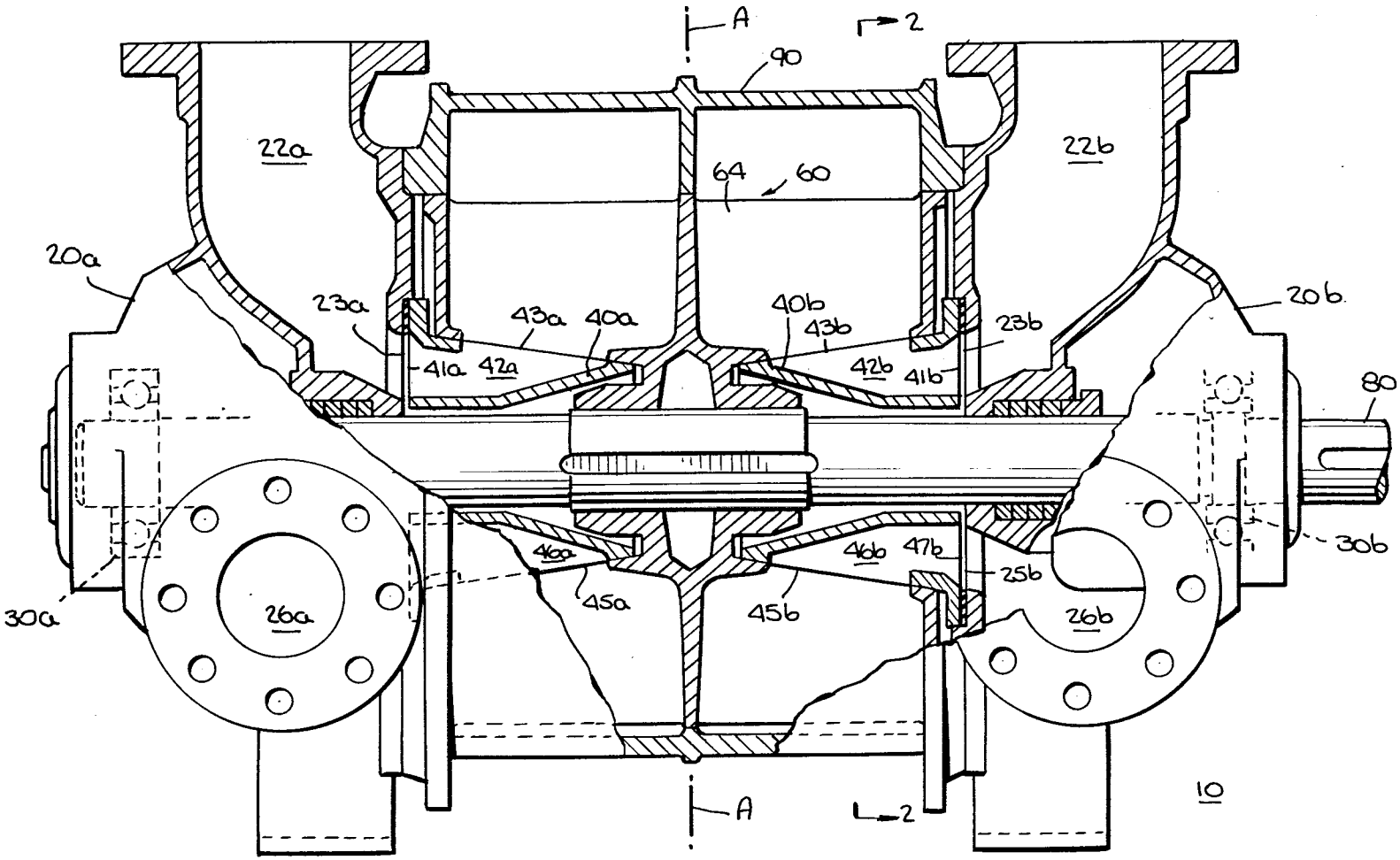
FIG. 1 is an elevational view, partly in section, of a conventional double-ended, single-lobe, conically ported liquid ring vacuum pump.

FIG. 1 shows a conventional double-ended, single-lobe, conically ported liquid ring vacuum pump 10. The two ends of pump 10 are mirror images of one another about the transverse plane including axis A—A. Accordingly, only the right-hand end of pump 10 (shown in cross section in FIG. 2) will be discussed in detail. Gas to be pumped enters stationary head member **20*b* via intake manifold 22*b*. Intake manifold 22*b* is connected to intake passage 42*b* in stationary conical port member 40*b* (shown in greater detail in FIGS. 3–6). The gas inlet flange opening 41*b* of port member 40*b* mates with the gas outlet opening 23*b* of head member 20*b*. The gas to be pumped flows from intake passage 42*b* into rotating rotor 60 via intake port 43*b***.

Rotor 60 is fixedly secured to rotating shaft 80. Shaft 80 is rotatably mounted by means of bearings **30*a* and 30*b* in head members 20*a* and 20*b*, respectively. Rotor 60 and shaft 80 rotate in the direction of arrow 62. Rotor 60 includes a plurality of circumferentially spaced, radially and axially extending blades 64. Rotor 60 is surrounded by an annular housing 90 which extends between head members 20***a* and 20*b* and which is eccentric to rotor 60. A quantity of pumping liquid (usually water) is maintained in housing 90. Rotor blades 64 engage the pumping liquid and form it into an annular ring inside housing 90 as rotor 60 rotates.

Figure 2:
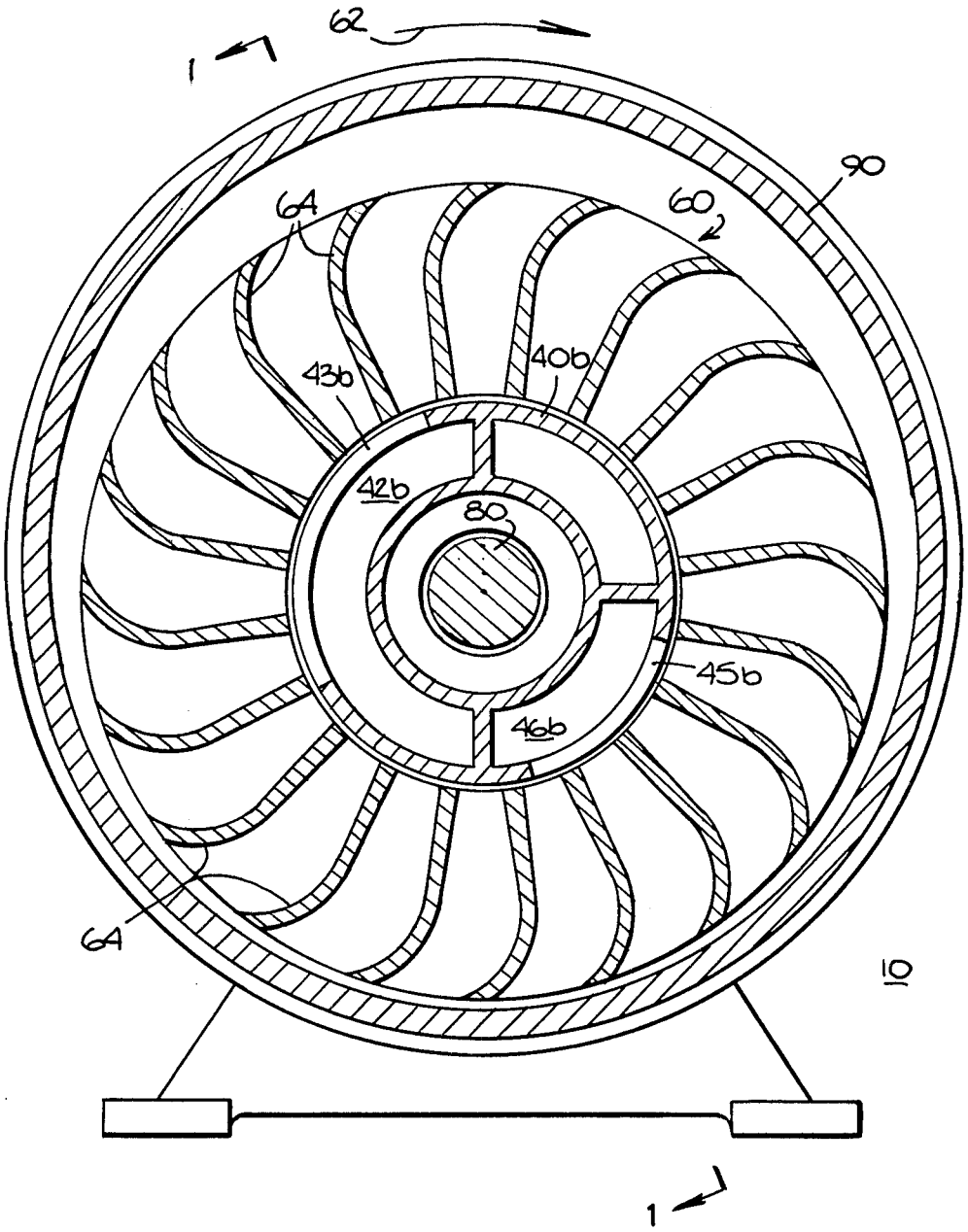
FIG. 2 is a cross sectional view taken along the line 2—2 in FIG. 1. The sectional portion of FIG. 1 is taken along the line 1—1 in FIG. 2.
Figure 3:
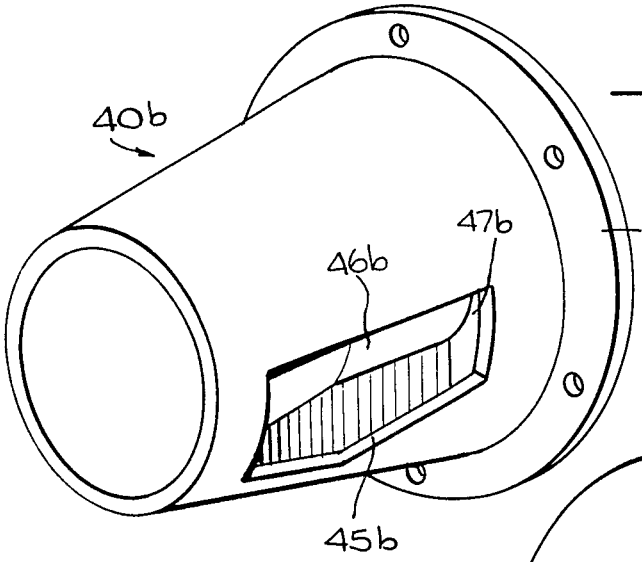
FIG. 3 is a perspective view of one of the port members in the vacuum pump of FIGS. 1 and 2.
Figure 6:
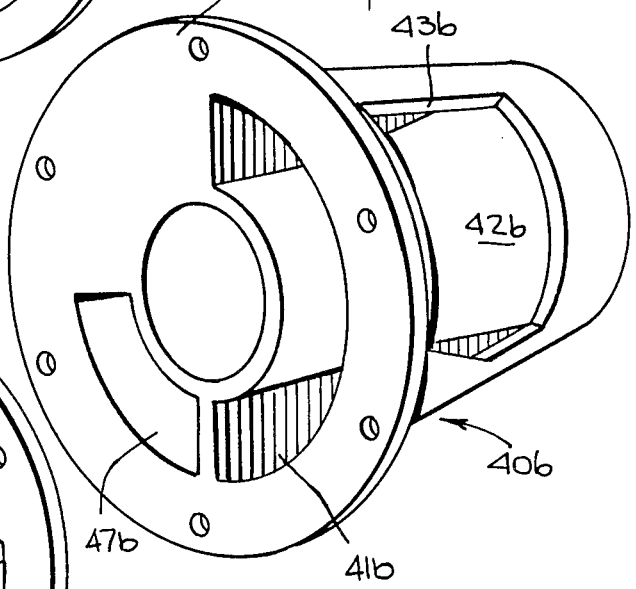
FIG. 6 is another perspective view of the port member of FIG. 3 taken in the opposite direction from FIG. 3.
Figure 4:
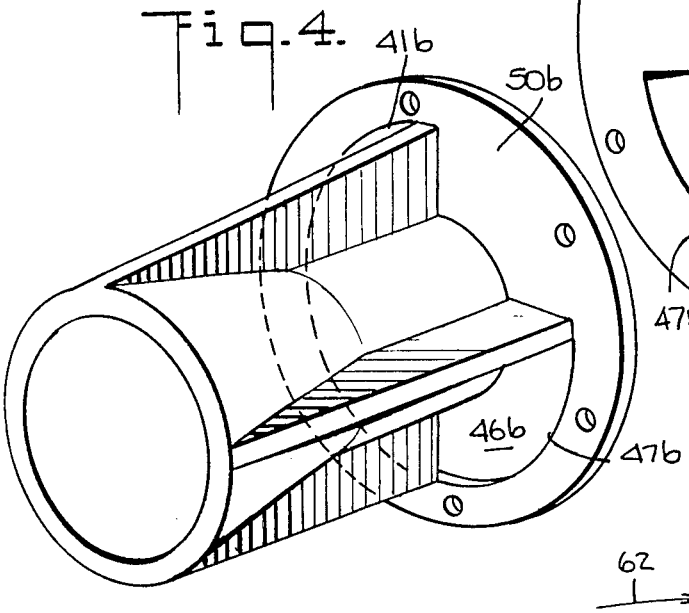
FIG. 4 is a perspective view of the port member of FIG. 3 with its outer frusto-conical surface member removed.
Figure 5:
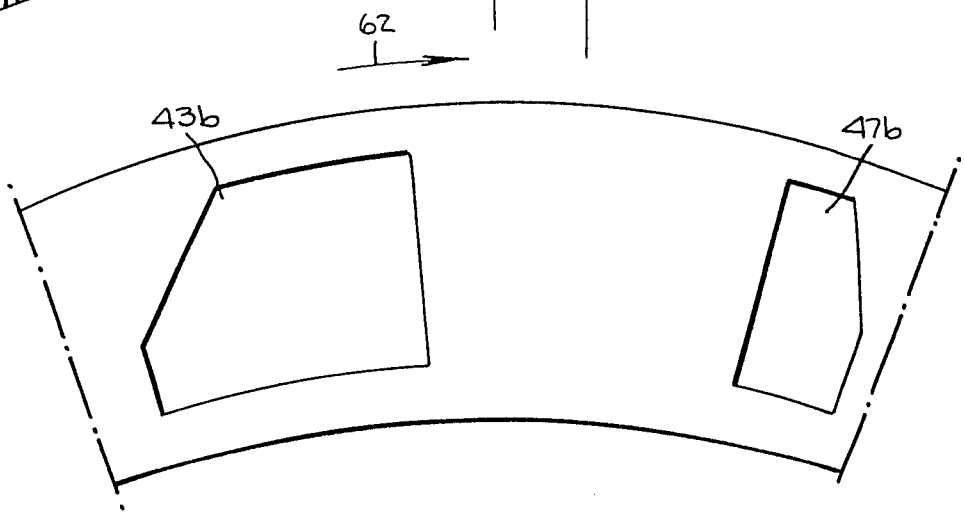
FIG. 5 is a planar projection of the outer frusto-conical surface of the port member of FIG. 3.
Figure 7:
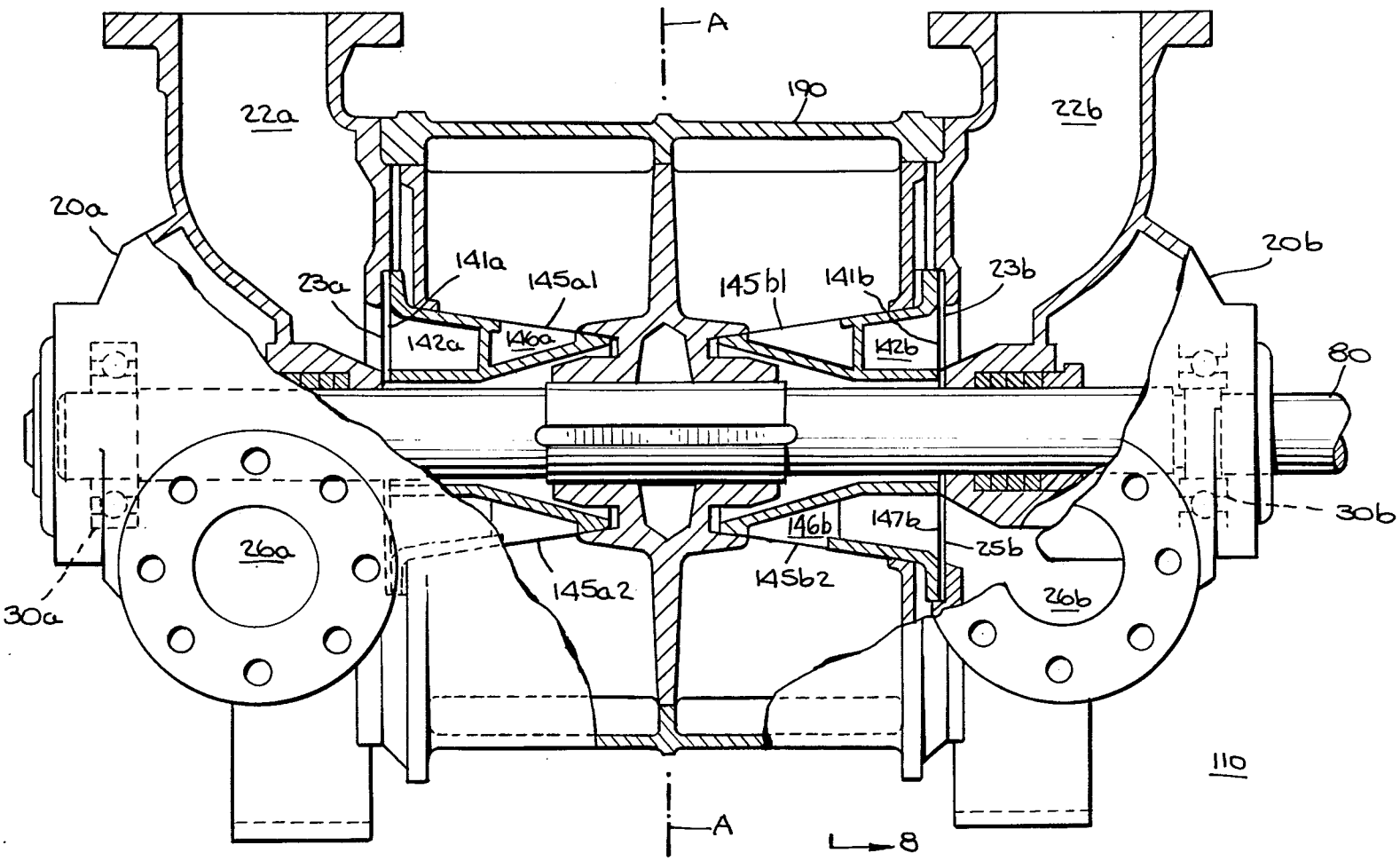
FIG. 7 is an elevational view, partly in section, of a double-ended, double-lobe, conically ported liquid ring compressor constructed in accordance with the principles of this invention.

On the left-hand side of the pump as viewed in FIG. 2 the inner surface of the liquid ring diverges from the outer surface of port member 40*b* in the direction of rotor rotation. Accordingly, on this side of the pump, the gas pumping chambers bounded by (1) adjacent rotor blades 64, (2) the inner surface of the liquid ring, and (3) the outer surface of port member 40*b* are expanding in the direction of rotor rotation. Gas is therefore pulled into these chambers via intake port 43*b*, and this portion of the pump is accordingly known as the intake zone of the pump.

On the right-hand side of the pump as viewed in FIG. 2 the inner surface of the liquid ring converges toward the outer surface of port member 40*b* in the direction of rotor rotation. Accordingly, on this side of the pump the abovementioned gas pumping chambers are contracting in the direction of rotor rotation. The gas in these chambers is therefore compressed in this compression zone of the pump, and the compressed gas is expelled via discharge port 45*b* and discharge passage 46*b* in port member 40*b*. Discharge passage 46*b* communicates with discharge manifold 26*b* in head member 20*b* via mating discharge flange opening 47*b* in port member 40*b* and gas inlet opening 25*b* in head member 20*b*.

In accordance with this invention, most of the parts of single-lobe vacuum pump 10 can also be used to provide a double-lobe compressor 110 as shown in FIGS. 7–12. Preferably, only housing 190 and port members 140 are different from the corresponding parts of pump 10. The other parts of compressor 110 are preferably the same as the corresponding parts of pump 10, and these parts therefore have the same reference numbers in the drawings of both devices. As in the case of vacuum pump 10, the two ends of compressor 110 are mirror images of one another about the transverse plane including axis A—A in FIG. 7.

Figure 8:
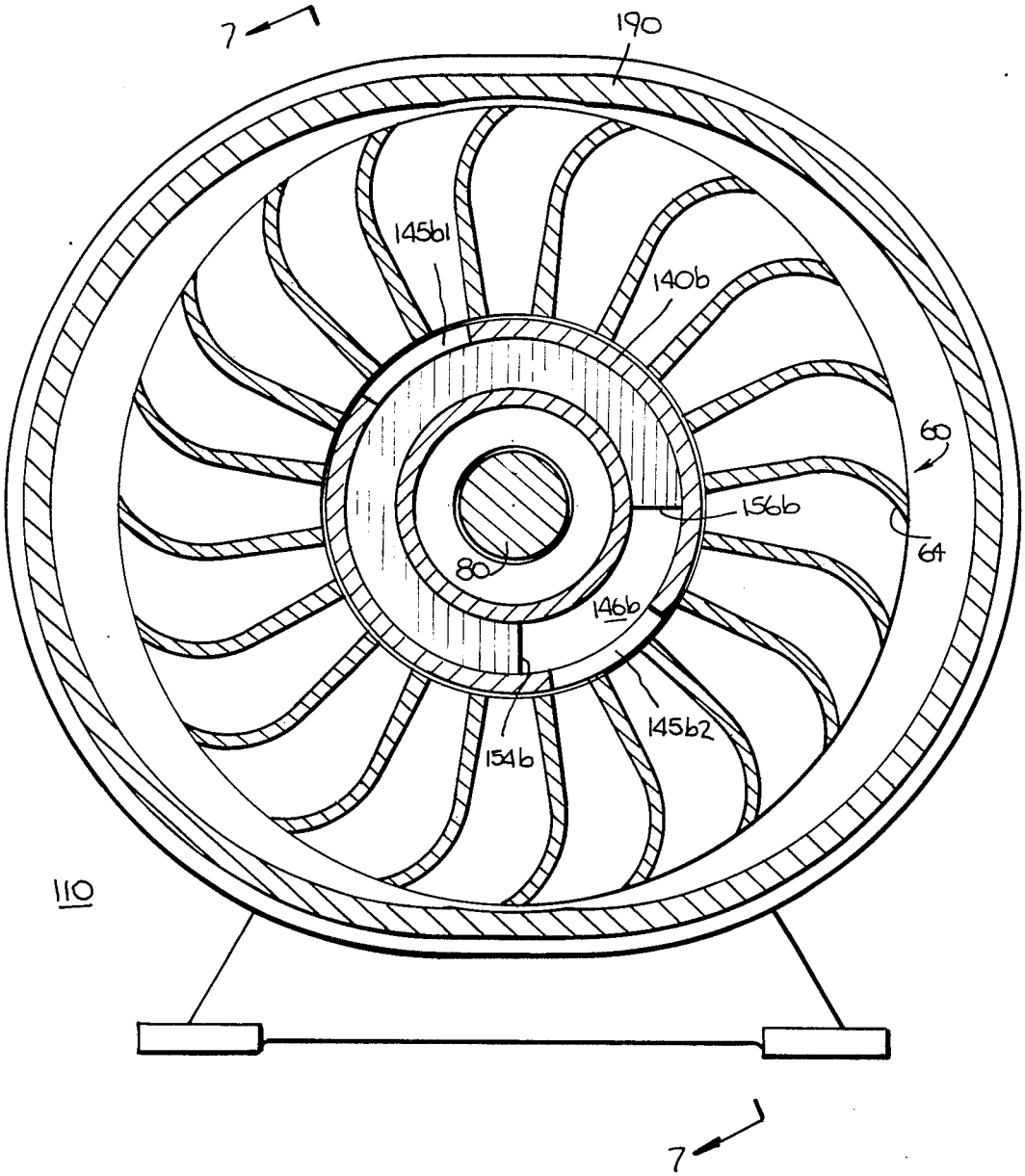
FIG. 8 is a cross sectional view taken along the line 8—8 in FIG. 7. The sectional portion of FIG. 7 is taken along the line 7—7 in FIG. 8.
Figure 9:
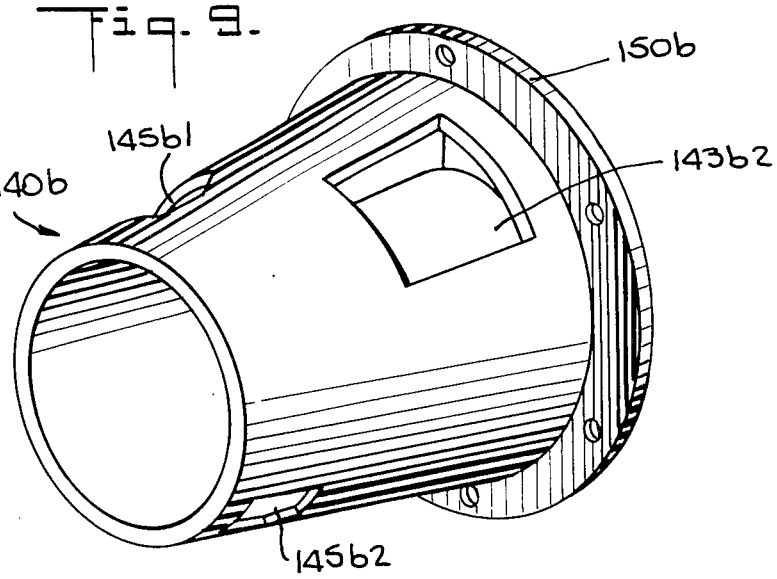
FIGS. 9–12 are views respectively similar to FIGS. 3–6 showing one of the port members in the compressor of FIGS. 7 and 8.
Figure 12:
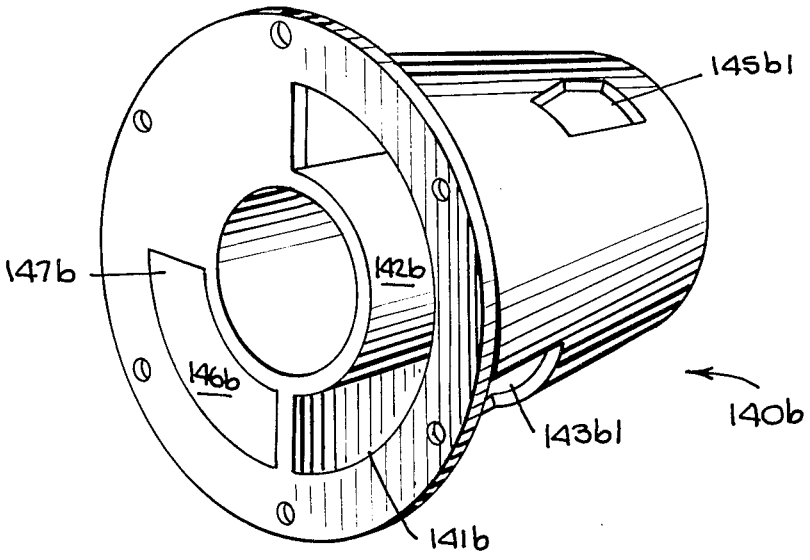
Figure 10:
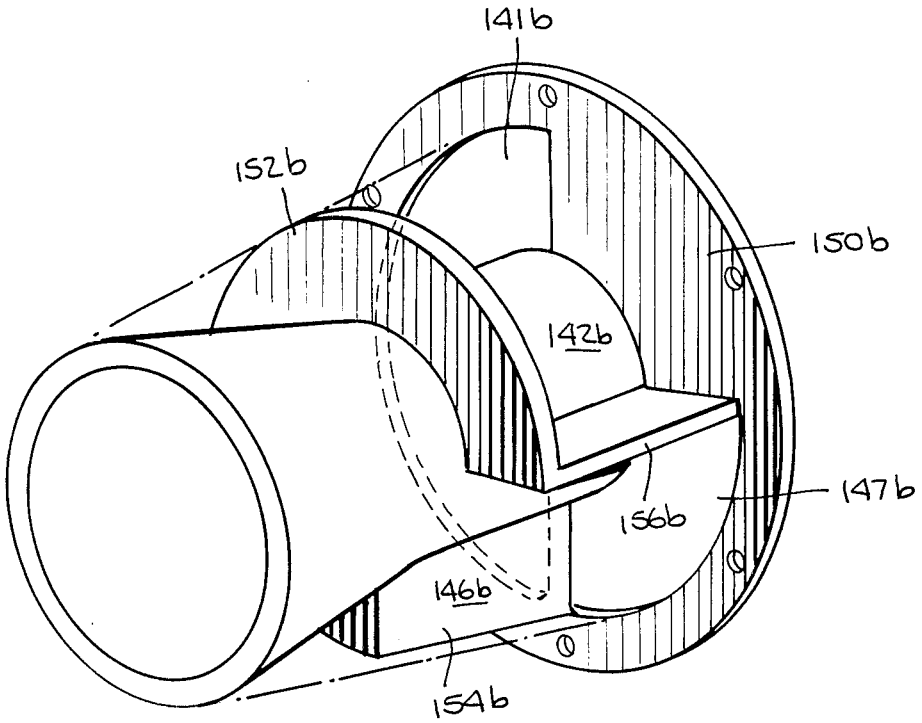
Figure 11:
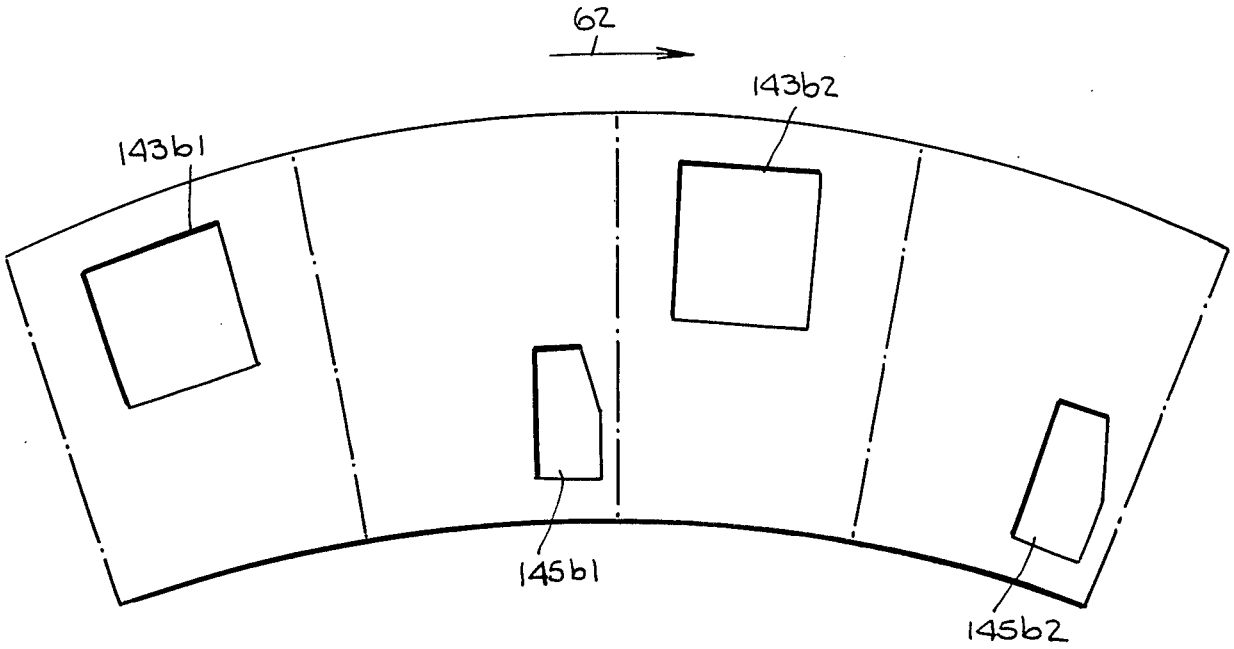

Considering first the parts of compressor 110 that are different from the corresponding parts of pump 10, the shape of housing 190 is best seen in FIG. 8. As shown in that Figure, housing 190 is concentric with shaft 80 and provides two intake zones (lower left and upper right as viewed in FIG. 8) and two compression zones (upper left and lower right as viewed in FIG. 8). Port member 140*b* is shown in greater detail in FIGS. 9–12.

The gas inlet flange opening 141*b* and gas discharge flange opening 147*b* of port member 140*b* are respectively similar to the corresponding openings 41*b* and 47*b* of port member 40*b* so that port member 140*b* communicates with head member 20*b* in exactly the same way that port member 40*b* communicates with that head member. The interior of port member 140*b*, however, differs from the interior of port member 40*b*. In particular, intake passage 142*b* extends axially only approximately one half the length of port member 140*b* from the plane of end flange 150*b* to intermediate flange 152*b*. Circumferentially, intake passage 142*b* extends approximately three quarters of the way around port member 140*b*, excluding only the one quarter of the circumference of the port member adjacent to gas discharge flange opening 147*b*. The circumferential ends of intake passage 142*b* are defined by axially and radially extending partitions 154*b* and 156*b*. The circumferential extent of intermediate flange 152*b* is co-extensive with intake passage 142*b*. Discharge passage 146*b* extends circumferentially all the way around port member 140*b* on the side of intermediate flange 152*b* remote from passage 142*b*. Discharge passage 146*b* communicates with gas discharge flange opening 147*b* via the gap in intermediate flange 152*b* and between partions 154*b* and 156*b*.

The conical outer surface of port member 140*b* has two circumferentially spaced intake ports 143*b*1 and 143*b*2, each of which communicates with intake passage 142*b*. Each of the intake ports 143*b*1 and 143*b*2 is located adjacent a respective one of the intake zones of the pump in order to admit gas to those zones. The conical outer surface of port member 140*b* also has two circumferentially spaced discharge ports 145*b*1 and 145*b*2, each of which communicates with discharge passage 146*b*. Each of discharge ports 145*b*1 and 145*b*2 is located adjacent a respective one of the compression zones of the pump in order to discharge compressed gas from those zones. Intake ports 143*b*1 and 143*b*2 are located between the planes of end flange 150*b* and intermediate flange 152*b*. Discharge ports 145*b*1 and 145*b*2 are located between the plane of intermediate flange 152*b* and the small end of port member 140*b*. For the most part, gas introduced into the pump via intake port 143*b*1 exits via discharge port 145*b*1, and gas introduced into the pump via intake port 143*b*2 exits via discharge port 145*b*2.

From the foregoing it will be seen that by changing only the housing (90, 190) and the port members (40, 140), either a single-lobe liquid ring vacuum pump or a double-lobe liquid ring compressor can be constructed using other parts that are identical for either the pump or the compressor.

Although the invention has been illustrated in the context of conically ported liquid ring pumps and compressors in which the port members are tapered inwardly in the direction away from end flange 50 or 150, those skilled in the art will appreciate that the invention is equally applicable to cylindrically ported liquid ring pumps and compressors in which the port members are cylindrical and therefore not tapered.

I claim:

1. A liquid ring compressor comprising:

an annular housing;

a quantity of pumping liquid maintained in the housing;

a rotor rotatably mounted in the housing and having a plurality of circumferentially spaced, radially extending blades for engaging the pumping liquid and forming it into a recirculating annular ring inside the housing, the housing being shaped to cause the inner surface of the liquid ring to diverge from the rotor axis in the direction of rotor rotation at two circumferentially spaced intake zones of the pump and to converge toward the rotor axis in the direction of rotor rotation at two circumferentially spaced compression zones of the pump, the intake and compression zones alternating circumferentially of the pump; and an annular port member concentric with the rotor and extending into an annular recess in a first axial end of the rotor, the port member containing an intake passage adjacent a first axial end of the port member and a discharge passage adjacent an opposite second axial end of the port member, the one of said passages which is adjacent the end of the port member which projects farther into the annular recess also including a portion adjacent the other axial end of the port member, the port member including partitions for isolating the intake and discharge passages from one another, and the port member further including (a) a gas inlet opening in the first axial end of the port member for admitting gas to be pumped to the intake passage, (b) two intake ports through the outer surface of the port member in communication with the intake passage, each intake port being adjacent a respective one of the intake zones for admitting gas from the intake passage to the associated intake zone, (c) two discharge ports through the outer surface of the port member in communication with the discharge passage, each discharge port being adjacent a respective one of the compression zones for discharging compressed gas from the associated compression zone to the discharge passage, and (d) a gas discharge opening in the first axial end of the port member for discharging compressed gas from the discharge passage.

2. The apparatus defined in claim 1 wherein the end of the port member adjacent the first end of the rotor includes a first flange disposed in a plane substantially perpendicular to the rotor axis, and wherein the gas inlet opening and the gas discharge opening are disposed in the first flange.

3. The apparatus defined in claim 1 wherein the port member has an outer surface which tapers inwardly toward the rotor axis in the direction into the annular recess, and wherein the intake passage is adjacent the larger diameter end of the port member.

4. The apparatus defined in claim 1 wherein the partitions include a second flange disposed in a plane substantially perpendicular to the rotor axis intermediate the first and second axial ends of the port member.

5. The apparatus defined in claim 4 wherein the second axial end of the port member is the end which is located farther into the annular recess.

6. The apparatus defined in claim 5 wherein the intake passage extends approximately 75% around the circumference of the port member adjacent the first axial end of the port member.

7. The apparatus defined in claim 6 wherein the discharge passage extends approximately 100% around the circumference of the port member adjacent the second axial end of the port member, and wherein the portion of the discharge passage adjacent the first axial end of the port member occupies the 25% of the circumference of that end of the port member which is not occupied by the intake passage.

8. The apparatus defined in claim 7 wherein the second flange is circumferentially coextensive with the intake passage, and wherein the portion of the discharge passage adjacent the first axial end of the port member is separated from the intake passage by two circumferentially spaced, axially and radially extending partitions.

9. The apparatus defined in claim 8 wherein the first axial end of the port member includes a first flange disposed in a plane substantially perpendicular to the rotor axis, and wherein the gas inlet opening and the gas discharge opening are disposed in the first flange and communicate respectively with the intake passage and the portion of the discharge passage adjacent the first axial end of the port member.

* * * * *